US005170331A

United States Patent [19]

Svehaug

[11] Patent Number: 5,170,331

[45] Date of Patent: Dec. 8, 1992

[54] ELEMENTAL FLASHLIGHT

[76] Inventor: Oswald C. Svehaug, 1010 San Ysidro Blvd., San Ysidro, Calif. 92073

[21] Appl. No.: 818,334

[22] Filed: Jan. 9, 1992

[51] Int. Cl.[5] ..... F21L 7/00

[52] U.S. Cl. ..... 362/157; 362/191; 362/203; 362/208

[58] Field of Search ..... 362/154, 157, 186, 190, 362/191, 362, 156, 203, 189, 208, 368, 802, 392, 396, 432

[56] References Cited

U.S. PATENT DOCUMENTS 2,522,660 9/1950 Bledsoe, Jr. ..... 362/208

4,504,890 3/1985 Chan ..... 362/203

4,750,095 6/1988 Huang ..... 362/190

5,008,785 4/1991 Maglica et al. ..... 362/190

*Primary Examiner*—Richard R. Cole

*Attorney, Agent, or Firm*—Ralph S. Branscomb

[57] ABSTRACT

An elemental flashlight utilizes a very simple, one-piece molded plastic frame which has open, clip-end mounts for a bulb and battery, with a conductor connecting between the bottom of the battery mount to the band contact of the light bulb so that when the battery is snapped into its mounted position the flashlight is on, and when the battery is inserted upside-down the nipple contact misses the conductor, so that the bulb is not lit.

6 Claims, 1 Drawing Sheet

ELEMENTAL FLASHLIGHT

BACKGROUND OF THE INVENTION

The invention relates to flashlights and other portable, battery-operated illumination devices, of which there are undoubtably thousands that have been produced and marketed since the invention of incandescent illumination.

Of the wide varieties of flashlights and other similar devices, probably the most commonly marketed type is the very simple flashlight with a screw-on bulb-mounting cap and a simple sliding conductor connected to an external longitudinally operable switch. When the switch is pushed toward the bulb end of the flashlight, the rear end of the conductor slides along another conductor which contacts the bottom of the lower most battery, and the forward end of the conductor slides into contact with a conductive disk which threadedly receives the light bulb.

These flashlights are very inexpensive. They also are almost universally unreliable, or subject to early corrosion problems. Anybody who has ever used flashlights has experienced the frustration of a flashlight which either will not go on, or blinks intermittently because of a problem with the sliding contacts. The batteries and bulb are known to be good. Obviously, the sliding contacts inside the flashlight cannot be observed in use because the flashlight will only work when completely enclosed. Also, it is usually difficult to reach down inside the elongated, narrow body of the flashlight to bend contacts so that they make better contact. Once the bending is done, the flashlight may still not work, inasmuch as corrosion between contact points may be the problem.

Much more expensive flashlights are of course much more reliable. Some flashlight-type devices, which are very expensive, plug into a wall outlet and constantly recharges the battery between uses. These units tend to be quite reliable, but have the obvious drawbacks of being very expensive for a flashlight and requiring the presence of an outlet, which may be absent or scarce in a garage or basement area, or simply not in the appropriate place. These flashlights also tend to be the removable type which are carried around in use rather than remaining at their mounting station.

Another problem experienced by virtually every flashlight is battery drainage when the unit is accidently left on, or jostled on, inside a suitcase or pocket. Although it would seem that a safety on a flashlight would add very little to the cost, they are not used, at least not in ordinary flashlights. Thus, people who pack flashlights from place to place, or have children who play with flashlights, have almost inevitably experienced trying to use a flashlight with completely dead batteries which were fresh at last use.

Therefore, there is a need for a simple, completely reliable flashlight having some built-in mechanism to ensure that the bulb is not lit when it is not desired to use the flashlight.

SUMMARY OF THE INVENTION

The instant invention fulfills the above-stated need by providing an elemental flashlight molded substantially in its entirety as a single plastic piece. The plastic piece comprises a frame with a back panel having a wall mounting point, and defining two forwardly-projecting open clips into which a light bulb and a flashlight battery snap, respectively. The bulb clip is configured such that it presses the bulb against the nipple end of the flashlight. A preferably non-corrosible conductor strap extends from the threaded contact band of the bulb down to the bottom of the frame, where it rests on a platform defined by the frame, and touches the bottom of the battery when the battery is in its nipple-up position. When the battery is reversed, the nipple falls short of the conductor strap so that the circuit is not completed and the bulb will not light.

The unit is so simple and so economical to make that any number of them could be put around and attic, basement, garage, or closet, etc., or carried around and hung on any available nail. The open construction in the use of stainless steel or other basically non-corrosible metal for the conductor strap, enables any conduction problem to be easily corrected.

DETAILED DESCRIPTION OF THE PREFERRED EMBODIMENT

Figure 3:
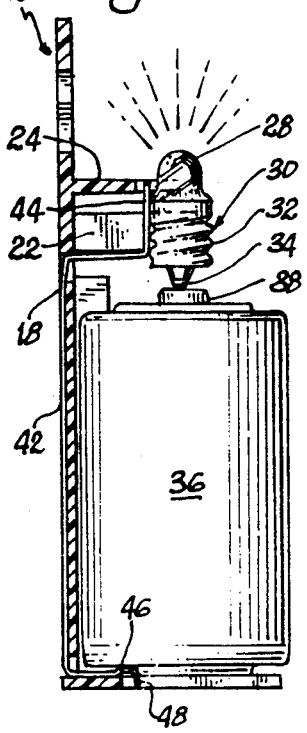
FIG. 3 is a section taken along line 3—3 of FIG. 1.
Figure 1:
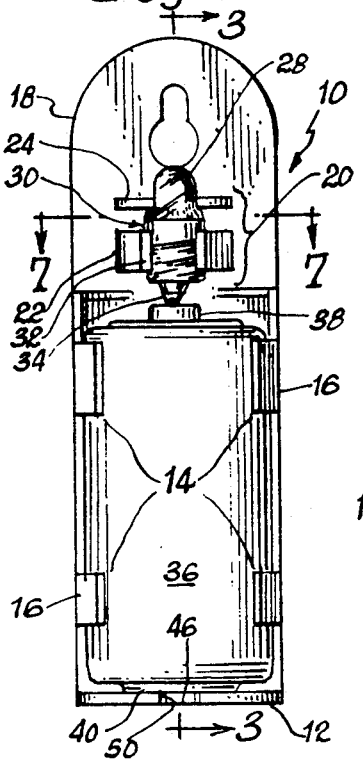
FIG. 1 is a front elevation view of the flashlight in its conducting lit mode.
Figure 2:
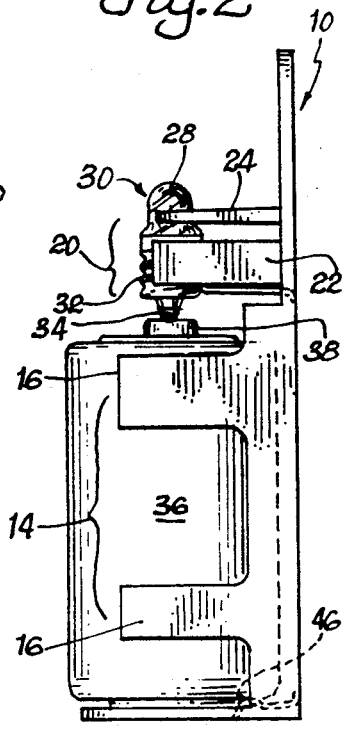
FIG. 2 is a side elevation view seen from the right of FIG. 1.
Figure 4:
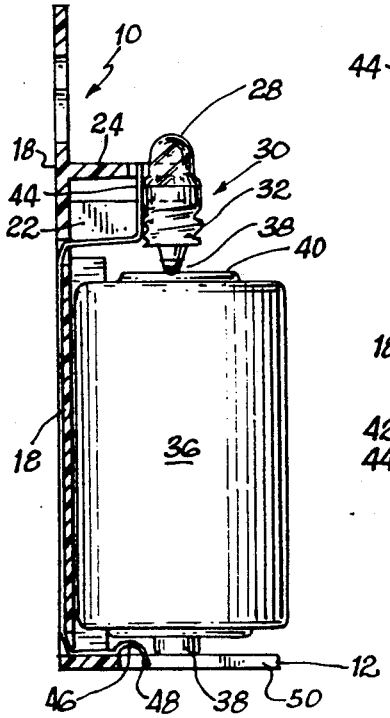
FIG. 4 is a section similar to FIG. 3, but with the battery inverted.
Figure 5:
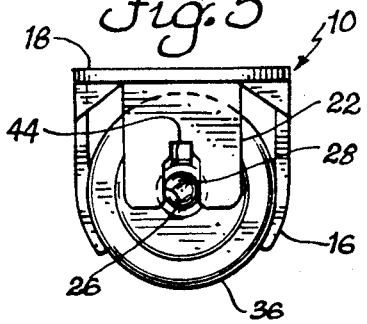
FIG. 5 is a top plan view of the flashlight.
Figure 6:
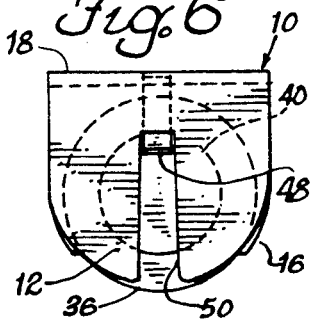
FIG. 6 is a bottom plan view of the flashlight.
Figure 7:
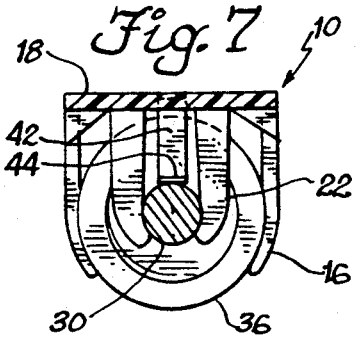
FIG. 7 is a section taken along line 7—7 of FIG. 1.
Figure 8:
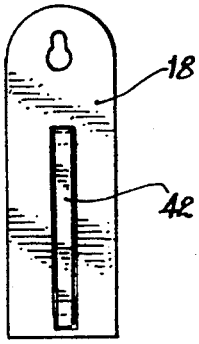
FIG. 8 is a rear elevation view of the flashlight illustrating the conductor strap and mounting hole.

The invention comprises a frame 10 which defines a bottom, battery-support platform 12 and a battery mount in the form of a clip 14 consisting of a pair of opposed, resilient arms 16. The resilient arms 16 allow the battery to be snapped in from the front of the frame until it rests against the back panel 18, as shown in FIGS. 3 and 4. The arms have an internal contour, best shown in FIG. 7, which securely seats the battery in the appropriate position.

The frame 10 also defines a bulb mount 20 comprising a lower bulb-gripper 22 and an upper tap 24 having a slot 26 in the end so that it grips the upper transparent portion 28 of the bulb 30. The bulb also has a threaded contact band 32 and a lower point contact 34. When both the battery 36 and the bulb 30 are pushed into their respective clips, as shown in FIG. 3, the contact point 34 of the light bulb is in pressing contact with the nipple contact 38 of the battery, which has a flat contact 40 at the other end. The tab 24 is resilient and spaced to act as a spring to bias the bulb downward into contact with the battery.

A conductor strap 42 extends from its upper, vertical part 44 which is in contact with the contact band 32, down around the back of the back panel 18 and then back and over the platform 12, where it defines a lobe 46, terminating in a distal end 48 which passes down through a slot 50 in the platform. This construction of the lobe 46 and the slot 50 provides an additional resilience to the lobe 46 to compliment the compressive pressure of the tab 24 to hold the bulb and battery together. The conductor strap should be made of a non-corrosible material to avoid the corrosion problems found in so many cheap flashlights. For example, stainless steel is a good material for the conductor strap, as is beryllium copper. Although these metals are somewhat more expensive than cheap steel, only a small amount is required for the conductor strap and the payoff in reliability of performance well justifies the slight additional expense.

As will be noted from FIGS. 3 and 4, the lobe 46 of the conductor strap does not extend all the way to the middle of the platform 12 so that whereas it extends out far enough to contact the flat contact 40 of the battery, it will not touch the nipple contact 38 as shown in FIG. 4. Thus, when the battery is inverted as shown in FIG. 4, no contact can be made between the battery and the conductor strap and there is no possibility that the flashlight will be turned on. This also eliminates the need for the switch, which is so often the cause of failure of inexpensive flashlights. Thus, this configuration provides the best of all possible worlds in that it is cheaper than even the cheapest of flashlights to produce and yet avoids the major drawback of cheap flashlights, which is switch failure or erratic operation, for example from corrosion.

It should be noted that whereas a single battery is disclosed, clearly the concept would be equally applicable if the single battery were replaced by a string of two or more batteries in a series and the appropriate modifications were made to the structure of the frame.

The simple, virtually failure-proof and inexpensive flashlight, which is disclosed herein, is made more practical by relatively recent improvements in flashlight batteries. Currently, batteries have a shelf life of a number of years. A modern alkaline C or D cell battery can be installed in one of these flashlights and left for five years, and then come on with full brightness. The simplicity and inexpensive nature of this device make it practical, along with long shelf-life batteries, to buy these units, for example, by the half-dozen and put them all around the house, not only in dark places but in easily accessible areas in case of power failure.

With a number of these units around, and with the full-proof manner in which battery drainage is prevented, the home or apartment dweller need no longer be concerned with whether or not a single flashlight has been left on or the switch has become inoperable or the contact corroded. The unit is so simple that corrosion is unlikely and, if it exists, it is easily correctable with a quick stroke of a cloth or sandpaper. The absence of a switch eliminates that possibility for failure, to create the optimal possible flashlight unit.

It is hereby claimed:

1. A flashlight comprising:

(a) a frontally open frame;

(b) said frame defining:

(i) a battery mount comprising a frontally open snap-in battery clip for at lease one battery;

(ii) a bulb mount for a bulb with an upper band contact and a lower point contact, said mount being positioned to hold said point contact against one end of said at least one battery when same is mounted in said battery mount;

(c) said bulb having a reduced-radius transparent end portion remote from said point contact and said bulb mount including a resilient slotted tab defined by said frame and extending to engage said transparent end portion in the slot therein and bias said battery toward said battery mount and expand to release said battery when said is snapped out of said battery clip;

(d) conductor means connecting said band contact to the end of said at least one battery remote from said bulb mount;

(e) said frame defining a bottom platform and said conductor means having a lower end terminating adjacent said platform eccentrically of the axis of a battery resting on said platform in said battery mount such that a battery having a central nipple contact on one end thereof will not touch said conductor means when mounted upside-down with said nipple contact toward said platform, whereby reversing said battery by snapping same out of, and back into, said battery clip upside-down turns said flashlight off and vice-verse such that an on-off switch is not required.

2. Structure according to claim 1 wherein said bulb mount comprises a frontally open snap-in bulb clip.

3. Structure according to claim 2 wherein said frame comprises a single molded plastic piece.

4. Structure according to claim 3 wherein said frame defines a planar back panel from which extend said battery clip and said bulb clip.

5. Structure according to claim 1 wherein said platform defines a slot and said conductor means defines a lobe arching away from said platform and terminating in a distal end passing through said slot such that said lobe is resilient.

6. Structure according to claim 5 wherein said conductor means is a stainless steel strap.

* * * * *